US006361725B1

(12) United States Patent
Sinsley

(10) Patent No.: US 6,361,725 B1
(45) Date of Patent: Mar. 26, 2002

(54) METHOD OF MOLDING ARTIFICIAL CERAMIC FIBER CONSTRUCTION PANELS

(75) Inventor: Wayne Sinsley, Salem, OH (US)

(73) Assignee: Edward Susany, North Lima, OH (US)

( * ) Notice: Subject to any disclaimer, the term of this patent is extended or adjusted under 35 U.S.C. 154(b) by 0 days.

(21) Appl. No.: 09/385,518

(22) Filed: Aug. 30, 1999

Related U.S. Application Data

(63) Continuation-in-part of application No. 09/318,688, filed on May 25, 1999, now abandoned.

(51) Int. Cl.[7] ..... B28B 1/52; B28B 1/26; B28B 7/26

(52) U.S. Cl. ..... 264/87; 264/37.19; 425/85; 249/55; 249/113

(58) Field of Search ..... 264/87, 86, 256, 264/37.19; 249/55, 113; 425/85

(56) References Cited

U.S. PATENT DOCUMENTS

| | | | | | |
|---|---|---|---|---|---|
| 3,832,108 | A | * | 8/1974 | Posch et al. | 425/85 |
| 3,870,777 | A | * | 3/1975 | Jakel | 264/71 |
| 3,880,972 | A | * | 4/1975 | Towne et al. | 264/87 |
| 4,877,417 | A | | 10/1989 | Crace | 44/535 |
| 4,882,114 | A | * | 11/1989 | Radvan et al. | 264/129 |
| 5,271,888 | A | | 12/1993 | Sinsley | 264/87 |
| 5,284,686 | A | | 2/1994 | Thow | 428/15 |
| 5,612,266 | A | | 3/1997 | Delvaux et al. | 501/123 |
| 5,700,409 | A | | 12/1997 | Corry | 264/87 |
| 5,800,875 | A | | 9/1998 | Hussong | 427/430.1 |
| 6,004,493 | A | * | 12/1999 | Hussong | 264/87 |
| 6,013,215 | A | * | 1/2000 | Iwamoto et al. | 264/87 |
| 6,077,467 | A | * | 6/2000 | Sinsley | 264/87 |

FOREIGN PATENT DOCUMENTS

| | | | | | |
|---|---|---|---|---|---|
| EP | 0329200 | A2 | * | 8/1989 | B29C/67/20 |
| GB | 2214178 | A | * | 8/1989 | C04B/35/80 |
| JP | 5-200713 | A | * | 8/1993 | B28B/1/42 |
| JP | 10-128721 | A | * | 5/1998 | B28B/3/02 |

OTHER PUBLICATIONS

Japanese Patent Office; Machine Translation of JP–10–128721–A; Sep. 8, 2001.*

Japanese Patent Office; Machine Translation of JP–5–200713–A; Sep. 8, 2001.*

* cited by examiner

*Primary Examiner*—Jan H. Silbaugh
*Assistant Examiner*—Michael I. Poe
(74) *Attorney, Agent, or Firm*—Harpman & Harpman

(57) ABSTRACT

A process for making an artificial mineral or ceramic panels that can be used in gas fireplaces. The process uses a screen mold having simulated pattern elements to impart a realistic exterior surface to the article. A slurry of mineral fibers is injected under pressure into the mold forcing excess water therethrough leaving the fibers impinged within the mold. The article thus formed is dried in an oven and can be processed for additional decorative coatings.

5 Claims, 5 Drawing Sheets

METHOD OF MOLDING ARTIFICIAL CERAMIC FIBER CONSTRUCTION PANELS

This is a CIP of U.S. patent application Ser. No. 09/318,688, filed May 25, 1999, now abandoned.

BACKGROUND OF THE INVENTION

1. Technical Field

This invention is directed to a process of molding artificial and decorative panel and logs for use in gas equipped fireplaces.

2. Description of Prior Art

Prior art processes for artificial log and constructing panels manufacturing typically use a screen mold with textured surface elements on the screen that is form fitted into an apertured support mold cavity into which a slurry of mineral or ceramic fibers is deposited. A vacuum is then applied to the mold drawing the liquid therefrom, leaving the mineral fibers collected on the screen surface. The log or panel is removed from the mold and dried in an oven to eliminate the remaining moisture present after molding of approximately 50%. After an extended drying time in the oven the log is removed and color coded for realism and then redried ready for use. See for example U.S. Pat. Nos. 4,877,417, 5,271,888, 5,284,686, 5,612,266, 5,700,409 and 5,800,875.

In U.S. Pat. No. 4,877,417, an artificial fireplace log is disclosed which is partially combustible having a clay carrier and consumable wood fiber portions.

U.S. Pat. No. 5,271,888 is directed towards a ceramic log molding process for forming lightweight synthetic ceramic logs having a flexible porous pattern screen using a vacuum source for withdrawing water from the mold slurry forming a log representation within the mold.

A combustible artificial log is disclosed in U.S. Pat. No. 5,284,686 having a composite log formed of ceramic concrete with ceramic fiber sections.

U.S. Pat. No. 5,612,266 shows a decorative non-combustible synthetic fire log formed my mineral foam in a mold shape as a nature wood log. The mineral foam composition is claimed. U.S. Pat. No. 5,700,409 discloses a method of molding an article in which a flexible mold having an article forming cavity is affixed to a suction chamber so as to release their article within the mold after the molding process.

Mineral fiber log processing is disclosed in U.S. Pat. No. 5,800,895 wherein a screen mold is used to impart an exterior log surface. A slurry containing mineral wool fibers is drawn into the mold by a vacuum leaving the mineral fibers within the mold.

SUMMARY OF THE INVENTION

An improved process for molding synthetic fiber logs and decorative panels used in gas fireplaces. The process uses a textured screen with a mold body into which a slurry of synthetic mineral wool fiber is injected under pressure and then molded under increased air pressure by driving the liquid out of the mold through a plurality of apertures. Once molded, continued air pressure partially dries the formed article to low moisture content in a shortened cycle time.

DESCRIPTION OF THE PREFERRED EMBODIMENT

Figure 1:
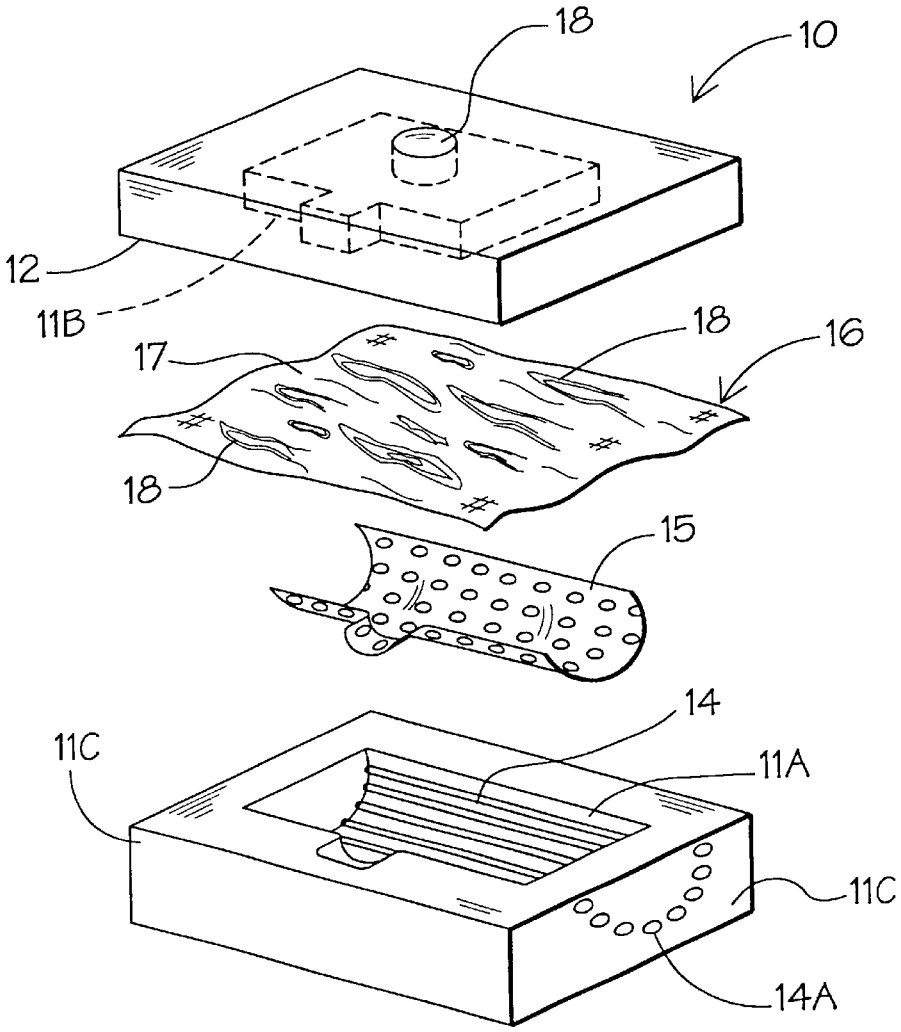
FIG. 1 is an exploded perspective view of an open log mold with fixed mesh lining and separable flexible porous screen to be positioned within the mold.
Figure 2:
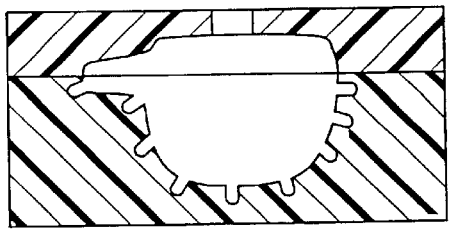
FIG. 2 is a cross-sectional view of the closed log mold illustrating a slurry inlet opening and plurality of grooves elongated longitudinally aligned grooves for liquid removal.
Figure 3:
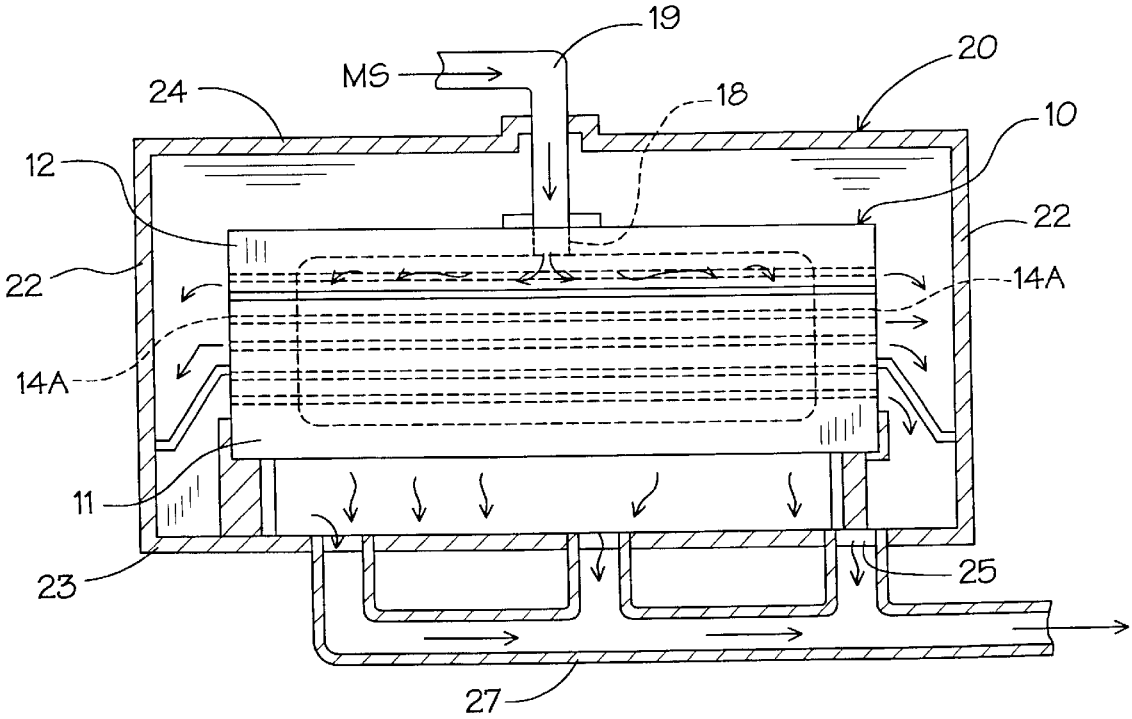
FIG. 3 is a partial cross-sectional view of the log mold within a mold station capture enclosure illustrating slurry inlet and liquid outlet portals in the mold base.

In the present improved process for molding synthetic logs for use in gas fireplace environments, a first step is illustrated in FIGS. 1–3 of the drawings wherein a two-piece mold assembly 10 can be seen having a base body member 11 and a removable top portion 12. Both the base body member 11 and removable top portion 12 have hollowed out interior surfaces 11A and 11B respectively for the formation of a log shaped cavity therebetween. The base and top members 11 & 12 have a plurality of elongated aligned surface grooves 14 connecting the interior surface 11A to its exterior surface 11C through outlet apertures 14A. A non-corrosive metal mesh 15 is contoured within the inner surface 11A of the base body member 11 and acts as a first channel diffuser of liquid in the process.

It will be evident from the above description that the base and top body members 11 and 12 respectively are removably secured by conventional molding processes together as will be well understood by those skilled within the art. The base and top body members 11 and 12 are typically made from castable synthetic compound as is illustrated in this example.

A flexible metallic mesh 16 preferably with a 46% open porosity rate is used as the actual molding surface 17 and has a realistic texture imparted thereon by the employment of synthetic appliques 17A bonded thereto for imprinting the natural look surface to the molded article. Typically, these appliques are applied to represent realistic exterior surface of naturally occurring logs thus imitating a bark consistency with various textures employed therein.

The assembled mold 10 has an inlet opening at 18 in the top body member for registration of an injection pipe 19, best seen in FIG. 3 of the drawings. The entire mold assembly 10 is mounted within a retainment enclosure 20 defining a mold station 21. The retainment enclosure 20 defines a liquid containment and collection structure having multiple upstanding sidewalls 22 with an integral base 23 and access lid 24 hingeably secured thereto so that an operator (not shown) can readily open and access the mold assembly 10 within for removal of the molded article after the molding process. The retainment enclosure's integral base 23 has a plurality of drain openings 25 communicating with a return pipe 27 for liquid associated with the molding process.

Figure 4:
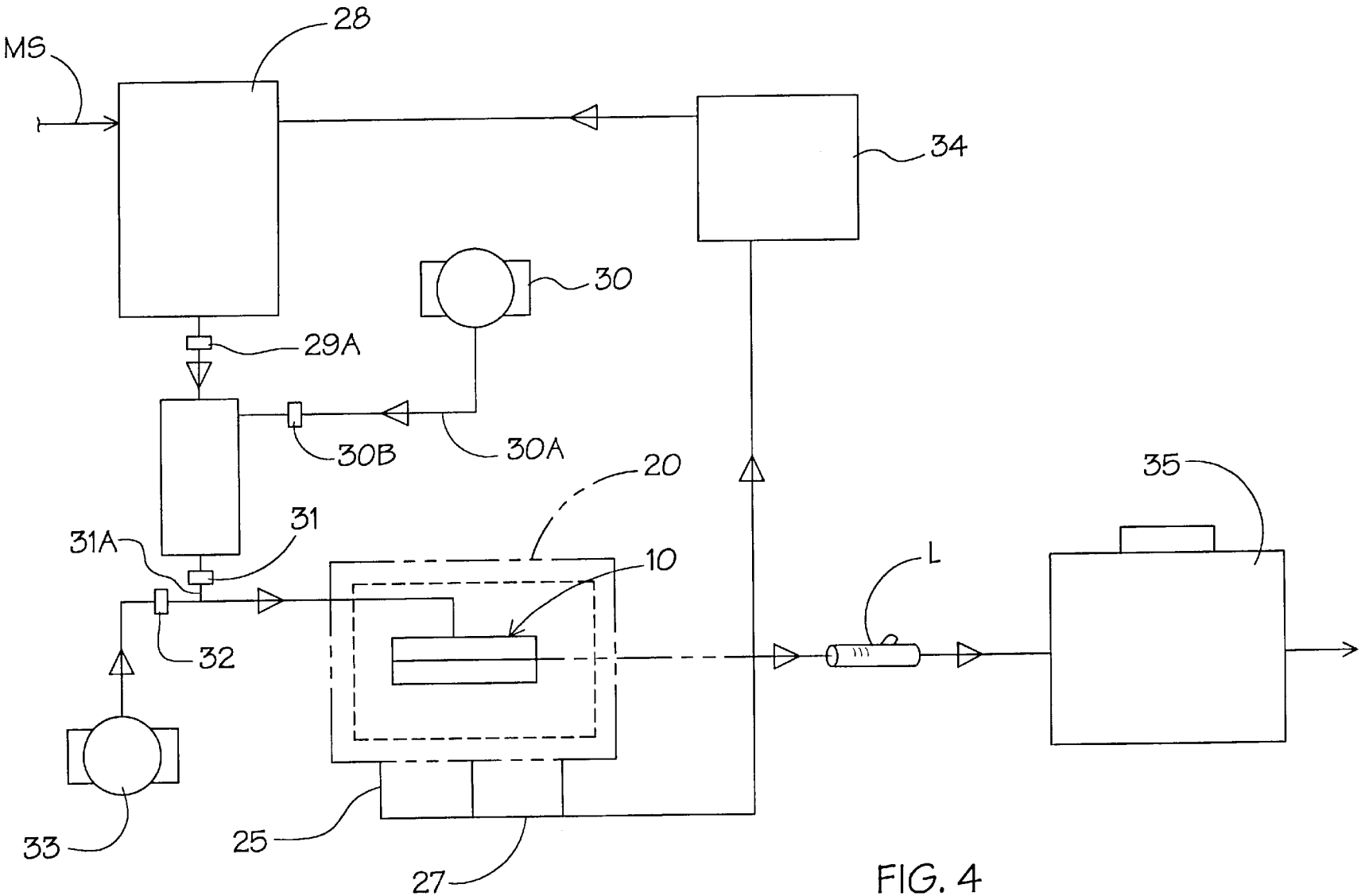
FIG. 4 is a block diagram of the required components of the pressure injection drawing process of the invention.

Referring now to FIG. 4 of the drawings, a systematic sequence steps can be seen wherein a storage and supply batch tank 28 is filled with a well known mold slurry formulation MS comprising; water, ceramic fiber, starch, and coloidal cilica/sol components. Such slurry formulations are typically set forth in the following batch ratios by weight; water 2,075 lb., ceramic fiber 30 lb., coloidal cilica/sol 3.125 lb. and chromite 1.50 lb. and starch 1.375 lb.

The ceramic fiber is manufactured by a number of companies, an example of same is brand name Fiber Frax, produced by the Carboriadue Company. The fibers are non-combustible with a stable reactivity and are made from alumina and silica and maintains their properties up to a temperature gradient of 2,300 Farenheit.

The coloidal cilica/sol has a positive charge for imparting adherence to themselves.

The chromite compound is generally made up of an iron chromite ore with a 3,800 degree Farenheit in this example chosen for illustration. The starch component preferably comprises a starch material made by Chemstar Products Company under the brand name Glucopus having a negative charge and is used to enhance the handling properties of the composition and formed log.

The hereinbefore described disclosed fiber slurry is discharged into a batch injection tank 29 by gravity flow through valve means 29A. The batch injection tank 29 is pressurized by a source of air pressure 30 by a supply line 30A and valving means 30B. An injection control valve 31 opens imparting the batch injection tank content slurry under a positive pressure range of 10–20 psi into the mold assembly 10 via a supply line 31A as best seen in FIG. 3 of the drawings, filling the mold cavity within. The injection control valve 31 is then closed and a drying control valve 32 is opened to a second source of compressed air 33. Air pressure supply to the mold assembly 10 in the range of 35 to 40 psi forces the liquid L out through the drain openings 25 within the mold base 23.

The water is driven out of the mold assembly 10 leaving the ceramic fibers collected on the molding surface 17 of the synthetic mesh 16 within. The water is captured within the retainment enclosure 20 collected and returned to a recycled water storage tank 34. After an express drying cycle of approximately three minutes, the retainment enclosure 20 is open and the log is retrieved from the mold assembly 10 having a highly reduced total moisture content in the range of approximately 30%.

The coalesce log L is transferred to an initial drawing chamber 35 to complete the initial formation of the ceramic fiber log.

Figure 5:
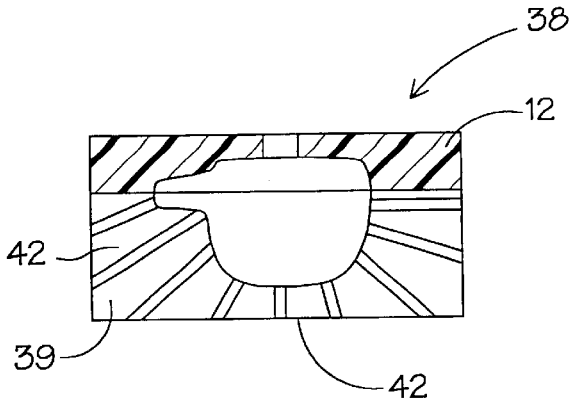
FIG. 5 is a cross-sectional view of an alternate mold base having a plurality of liquid clear apertures therein.

Referring now to FIG. 5 of the drawings, an alternate mold assembly 38 is disclosed wherein an alternate mold base 39 can be seen having a plurality of liquid dispersion apertures 40 extending from an inner surface 41 to the outer exterior surface 42 of the mold base 39. The alternate mold assembly 38 is used within the hereinbefore described retainment enclosure 20 and is injected with the mold slurry MS in the same manner as that of the previous mold assembly 10 described above.

Figure 6:
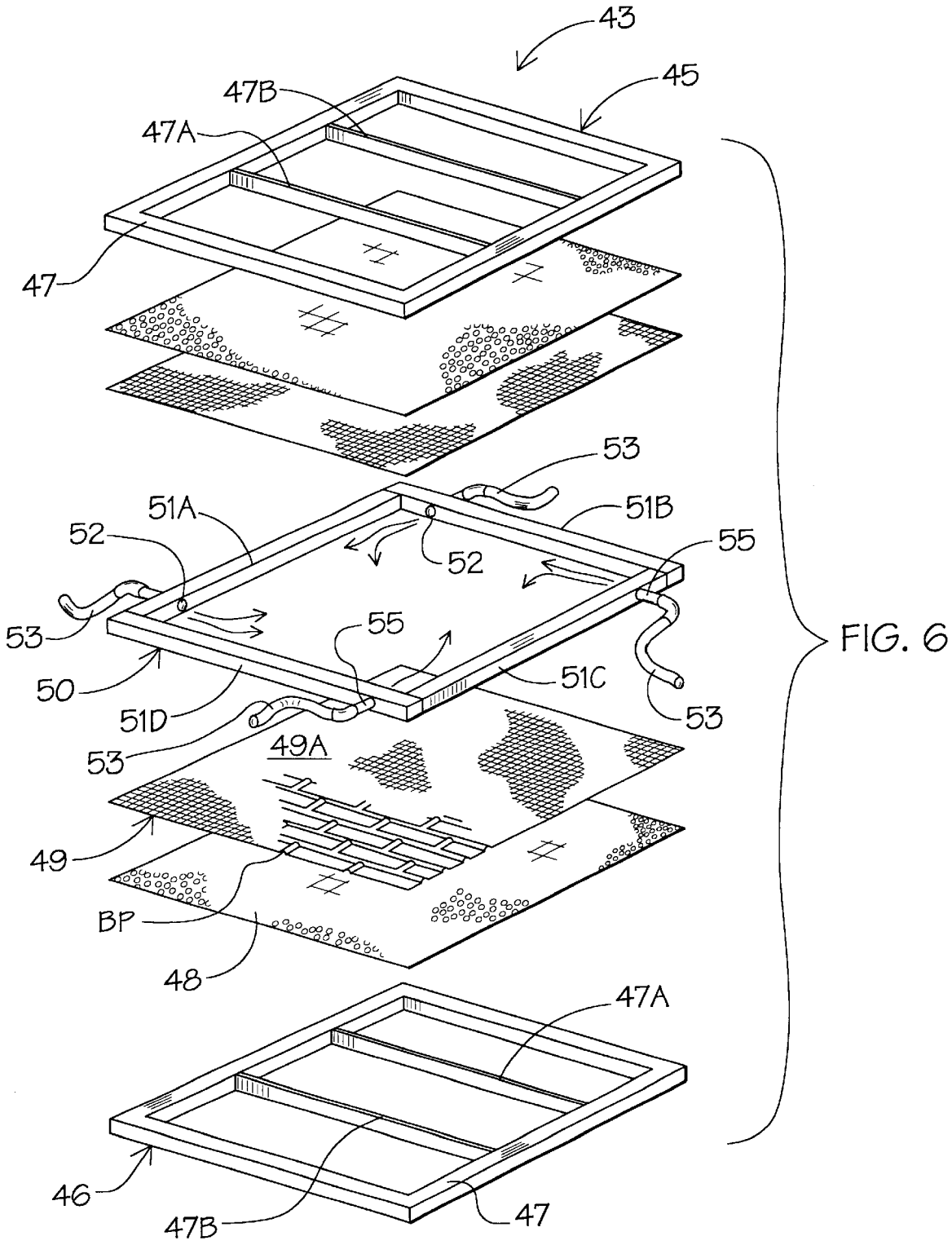
FIG. 6 is an exploded perspective view of a heat resisting fireplace construction panel illustrating support frames and mold screens.
Figure 8:
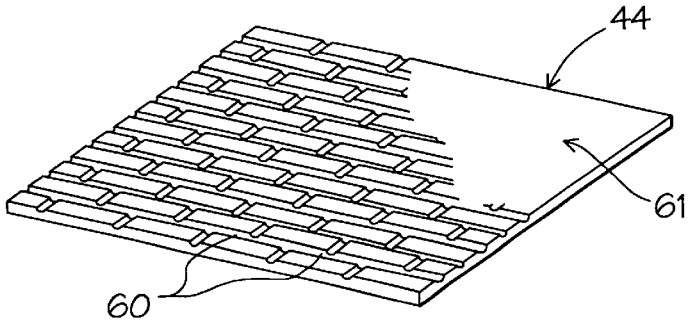
FIG. 8 is a perspective view of a molded decorative panel.
Figure 7:
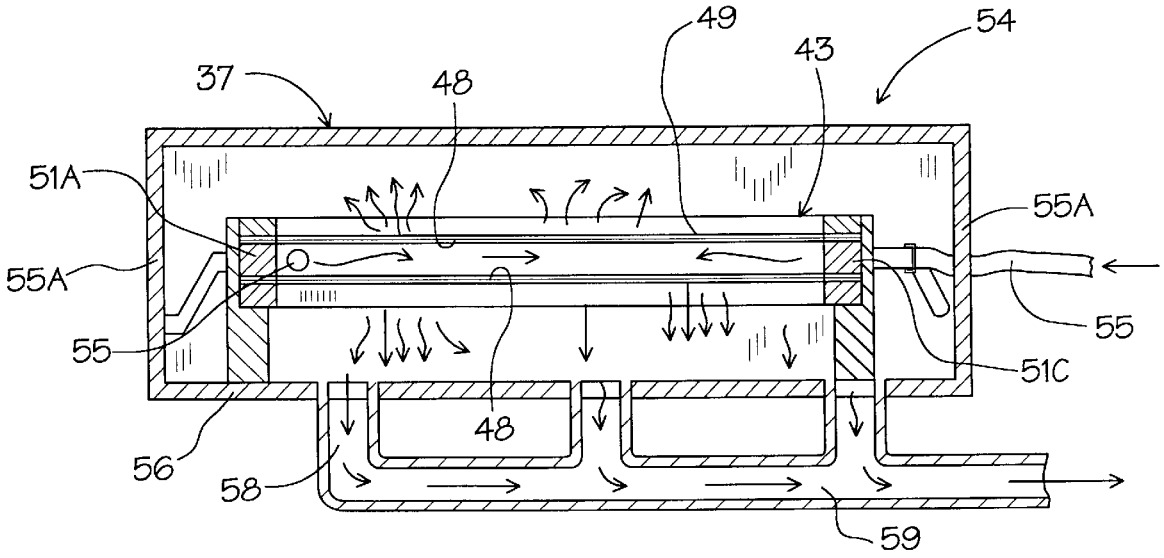
FIG. 7 is a cross-sectional view of a closed mold shown in FIG. 6 within a mold station aperture enclosure with multiple slurry supply inlets and outlet portions in the base of the enclosure.

Referring now to FIGS. 6–8 of the drawings, an artificial fiber panel mold 43 and associated molding process for decorative heat resistant fireplace panels 44 can be seen. The molding apparatus chosen to illustrate the process in this example has a pair of oppositely disposed support frames 45 and 46. Each of the support frames 45 and 46 have a generally square metal frame 47 with a pair of spaced parallel transversely extending braces 47A and 47B extending therebetween.

An apertured non-corrosive metal mesh 48 extends across and is secured to each support frames 45 and 46. A metallic mesh 49 having a 40% open surface being the actual molding surface extends over the respective apertured metal mesh 48 in abutting relation thereto.

In the example chosen for illustration, a raised brick mold pattern BP is bonded to the inner surface 49A of one of the mesh surfaces 48 so as to imprint a brick pattern onto the side of the molded panel. The mold pattern BP consist of interengaging raised bands of metal which provide a negative impression illustrating the joints between the brick as would be found on a normal brick panel laid up with brick and mortar (not shown).

A mold frame 50 is removably positioned between the respective hereinbefore described support frames 45 and 46. The mold frame 50 is formed from a plurality of interconnected frame bars 51A, 51B, 51C and 51D each which is cross-sectionally square having an inlet and outlet apertures 52 inwardly of one end thereof. Slurry supply lines 53 communicate with fittings 55 in each of the respective apertures 52 and are interconnected to a supply of the mold slurry formulation MS as hereinbefore described.

The assembled panel mold 43 is placed within a modified liquid containment and collection structure 54, best seen in FIG. 7 of the drawings having multiple upstanding sidewalls 55 and integral base 56 with a hinged access lid 57 for operator access thereto as will be well known to those skilled in the art.

A plurality of drain and return apertures 58 are formed within the bottom 56 in communication with a product return pipe 59.

In operation, the panel mold 43 is hooked up to the hereinbefore described batch injection tank 29 pressurized by the air pressure 30, etc. The mold slurry MS is injected into the panel mold 43 by the multiple slurry supply lines 53 and the registering apertures therein.

The slurry is thus injected by the multiple aperture injection ports 52 imparting a vortex fill action within the cavity of the panel mold 43. The mold slurry MS passes over and through the screen mold surfaces 49 depositing interlocking fibers thereon building up a solid mass within the cavity forming the synthetic fiber panel 44, best seen in FIG. 8 of the drawings.

The panel 44, in this example, has a brick pattern 60 on its exterior surface 61. The panel thus formed has a greatly reduced moisture content by the mold steps reducing drying time and consequently production time. The result is a high quality finished heat resistant molded panel with a molded decorative surface.

It will thus be seen that an improved process for molding synthetic logs and panels for use in gas fireplaces wherein the logs and panels L have an initial lower moisture content by use of the pressure injection and drawing sequences which reduces the primary oven drying cycle. Additionally, it will be seen that by use of the pressure collation and primary drying steps a much finer texture detail is imparted to the finished surfaces than hereinbefore has been possible with traditional dip vacuum molding process.

It will be apparent to those skilled in the art that various changes and modifications may be made therein without departing from the spirit of the invention.

Therefore I claim:

1. The method of molding synthetic ceramic fiber construction panels that can be used in gas fireplaces and high temperature environments comprises the steps of;

a. providing a pair of oppositely disposed support frames, b. securing first and second mold screens to each of said a support frames, said support frames having an open area within, c. positioning said support frames on opposite sides of a mold frame to define a mold cavity therebetween, d. introducing a ceramic fiber slurry under pressure into said mold cavity via multiple inlets within said mold frame, e. coalescing ceramic fibers of said ceramic fiber slurry on the respective mold screens within said mold cavity by an injection of air pressure, f. express drying of said coalesced ceramic fibers by forcing excess liquid out of the mold cavity by air pressure, g. capturing and recovering said excess liquid from said mold cavity within a retainment enclosure, h. removing the coalesced ceramic fibers in the form of a heat resistant panel and drying said panel at an elevated temperature during a second drying step.

2. The method set forth in claim 1 wherein said step of introducing the ceramic fiber slurry under pressure comprises a batch injection tank, a source of air pressure communication with said tank and valving means interconnecting said tank and said source of air pressure.

3. The method set forth in claim 1 wherein, in said step of coalescing said ceramic fibers into a panel by air pressure, said air pressure is in the range of between 10 and 15 psi.

4. The method set forth in claim 1 wherein, in said step of excess express drying said coalesced fiber within said mold under air pressure, said air pressure is in the range of 35–40 psi.

5. The method set forth in claim 1 wherein the step of capturing and recovering said excess liquid from said mold within the retainment enclosure further comprises a plurality of drain openings in said retainment enclosure interconnected with a recovery tank.

* * * * *